US005481289A

United States Patent [19]

Arashima et al.

[11] Patent Number: 5,481,289

[45] Date of Patent: Jan. 2, 1996

[54] INK SUPPLY MECHANISM, INK JET CARTRIDGE PROVIDED WITH SUCH A MECHANISM, AND INK JET RECORDING APPARATUS PROVIDED WITH SUCH A MECHANISM

[75] Inventors: Teruo Arashima, Kawasaki; Hiroshi Sugitani, Machida; Kazuaki Masuda, Kawasaki; Masami Ikeda, Yokohama; Masami Kasamoto, Ayase; Seiji Suzuki, Kawasaki; Hiroyuki Ishinaga, Tokyo; Jun Kawai, Yokohama; Yuji Kamiyama, Fujisawa, all of Japan

[73] Assignee: Canon Kabushiki Kaisha, Tokyo, Japan

[21] Appl. No.: 128,663

[22] Filed: Sep. 30, 1993

[30] Foreign Application Priority Data

Oct. 2, 1992 [JP] Japan ..... 4-289673

[51] Int. Cl.[6] ..... B41J 2/20

[52] U.S. Cl. ..... 347/93; 347/87

[58] Field of Search ..... 347/93, 87, 86

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,514,743 | 4/1985 | Roschlein et al. | 346/140 R |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 5,155,502 | 10/1992 | Kimura et al. | 346/140 R |
| 5,231,424 | 7/1993 | Kaneko et al. | 346/140 R |

FOREIGN PATENT DOCUMENTS

| | | | |
|---|---|---|---|
| 0121894 | 10/1984 | European Pat. Off. . | |
| 0444654 | 9/1991 | European Pat. Off. . | |
| 0488829 | 6/1992 | European Pat. Off. . | |
| 0558294 | 9/1993 | European Pat. Off. . | |
| 54-056847 | 5/1979 | Japan . | |
| 59-123670 | 7/1984 | Japan . | |
| 59-138461 | 8/1984 | Japan . | |
| 196263 | 11/1984 | Japan | 347/93 |
| 60-071260 | 4/1985 | Japan . | |
| 99662 | 6/1985 | Japan | 347/93 |
| 198255 | 10/1985 | Japan | 347/93 |
| 1186331 | 7/1989 | Japan . | |
| 207662 | 9/1991 | Japan | 347/93 |
| 110157 | 4/1992 | Japan | 347/93 |

*Primary Examiner*—N. Le

*Attorney, Agent, or Firm*—Fitzpatrick, Cella, Harper & Scinto

[57] ABSTRACT

An ink supply mechanism, which supplies ink from an ink container for storing ink to an ink jet recording unit which discharges ink, comprises a first filter member provided in an ink outlet section of the ink container; an ink supply passage which conductively connects the ink jet recording unit and the ink container for supplying ink from the ink container to the ink jet recording unit; and a second filter member provided in the ink supply passage between ink discharging ports of the recording unit and the first filter member. The second filter member is provided with holes which create the capillary force greater than the negative pressure in the ink container. With the above structure, it is possible to provide an ink jet recording apparatus capable of making the recovery amount compatible between a usual recording device and a recording device of a high-speed type, making a recording device of a high-speed type usable in a usual recording apparatus, and improving the ink usage efficiency in the recovery process.

29 Claims, 6 Drawing Sheets

INK SUPPLY MECHANISM, INK JET CARTRIDGE PROVIDED WITH SUCH A MECHANISM, AND INK JET RECORDING APPARATUS PROVIDED WITH SUCH A MECHANISM

BACKGROUND OF THE INVENTION

1. Field of the Invention

The present invention relates to an ink supply mechanism which supplies ink from an ink container for reservoiring or storing ink to an ink jet recording unit, an ink jet cartridge provided with such a mechanism, and an ink jet recording apparatus provided with such a mechanism.

2. Related Background Art

A recording apparatus having the functions of a printer, a copying machine, a facsimile apparatus, and the like or a recording apparatus which is used as an output equipment for a complex machine or a work station, which includes a computer, a word processor, and the like, are structured to record an image (including characters, marks, and the like) on a recording material (recording medium) such as a sheet or a thin plastic sheet (OHP and others) in accordance with image information. The foregoing recording apparatuses can be divided into such types as ink jet, wire dot, thermo-sensitive, and laser beam, among others types by the recording method to be employed as recording means.

Of these types, the ink jet type (ink jet recording apparatus) is to record by discharging ink onto a recording material from recording means (a recording head). This type enables its recording means to be fabricated compactly, a highly precise image to be recorded at a high speed, and an ordinary sheet to be used for recording without any particular treatment. This type has further advantages such as an inexpensive running cost, lesser noises brought about by a non-impact method, and the ease with which to record a color image using a variety of color inks.

Particularly, for the recording means (recording head) of the ink jet method which utilizes thermal energy for discharging ink, it is easy to fabricate the head having a highly densified arrangement of liquid passages (discharging port arrangement) by forming electrothermal transducers, electrodes, liquid passage walls, a ceiling plate, and others in the form of a thin film on a base board through the semiconductor fabrication processes such as etching, deposition, and sputtering, hence making it possible to make the apparatus more compactly. Also, by utilizing the advantages of the IC technologies and the micro-processing techniques, it becomes easier to elongate the recording means or enable it to provide more area (to be more two-dimensional), hence enabling an easier implementation of a fully multiple arrangement and higher densified assembling of the recording means.

Generally, the above-mentioned recording means for an ink jet recording apparatus comprises an ink discharging unit capable of generating fine ink droplets, an ink supply unit to guide ink to the ink discharging unit, and an ink tank unit which contains ink. Also, the ink jet recording apparatus is generally provided with a recovery mechanism for eliminating the defective discharging of the recording means. The recovery amount (the discharging ink amount used for the recovery process) is usually set at a value of the volume of a part from the discharging ports to the filter for removing dust particles and air bubbles in the ink, which is located on the end of the ink tank side of the ink supply unit, +α.

However, if the recording means is designed in accordance with the above specification, the volume between the discharging ports and the filter inevitably becomes great when the area of the filter is made large in order to reduce the flow resistance for the intended high-speed ink discharging. As a result, the amount of discharging ink used for recovery process becomes great, hence creating a problem that the amount of ink used for the purpose other than recording is remarkably increased.

As in the conventional example described above, the greater volume between the discharging ports and filter brings about the greater amount of ink used for the recovery process. Thus, the following drawbacks are encountered:

Firstly, since there is no compatibility in the recovery amount between an ordinary recording head and a high-speed type recording head, it becomes impossible to use a high-speed type recording head for the ordinary recording apparatus because of the flow resistance created by the filter which results in the insufficient ink supply.

Secondly, as the recovery amount is greater in the high-speed type recording head than the ordinary recording head, the amount of ink used for the purpose other than recording becomes greater, thus wasting more ink. Accordingly, the ink usage efficiency is inevitably lowered.

SUMMARY OF THE INVENTION

The present invention is designed in consideration of these technical problems. It is an object of the invention to provide an ink supply mechanism capable of proving the compatibility of the recovery amount between an ordinary recording head (recording means) and a high-speed type recording head (recording means), making the high-speed type recording head usable in an ordinary recording apparatus, and improving the ink usage efficiency in the recovery process, as well as an ink jet recording apparatus provided with such a mechanism.

It is another object of the present invention to provide an ink supply mechanism which makes it possible to execute the head recovery process in an ordinary recovery amount even when the area of the filter located at the end of an ink supply tube is made large in order to increase the ink amount in the flow passage (for a high-speed recording execution), so that the compatibility between an ordinary head and a high-speed type head is obtained, and also, the ink usage efficiency in the recovery process is improved, as well as an ink jet recording apparatus provided with such a mechanism.

It is still another object of the present invention to provide an ink supply mechanism in which, besides a filter arranged on the ink outlet of an ink container, an intermediate filter is provided in the midway of an ink flow passage from the ink discharging port to the filter, and the capillary force of the intermediate filter for the ink is set at a value greater than the negative pressure in the ink container, as well as an ink jet cartridge provided with such a mechanism, and an ink jet recording apparatus provided with such a mechanism.

It is a further object of the present invention to provide an ink supply mechanism for which each of the volumes between the ink discharging ports and an intermediate filter, and the intermediate filter and the filter arranged on the ink outlet is set at a value substantially equal to the conventional recovery volume between the ink discharging ports and the filter, and then, the area of the filter on the ink outlet is designed to be large, as well as an ink jet cartridge provided with such a mechanism, and an ink jet recording apparatus provided with such a mechanism.

It is still a further object of the present invention to provide an ink supply mechanism capable of recovering a recording head (of a high-speed type) having a large recovery amount by increasing the number of recoveries (the number of the intermediate filter plus one to cover such increased amount of recovery through the arrangement of intermediate filters in the ordinary recording apparatus whose recovery amount is small, and at the same time, being capable of recovering the ordinary recording head with a small recovery amount (one-time recovery), as well as an ink jet cartridge provided with such a mechanism, and an ink jet recording apparatus provided with such a mechanism.

It is another object of the present invention to provide an ink supply mechanism to supply ink from an ink container reservoiring ink to the ink jet recording unit provided with the ink discharging ports for discharging ink, which includes the following:

a first filter member which is arranged on the ink outlet of the ink container;

an ink supply passage to supply ink from the ink container to the ink jet recording unit by conductively connecting the ink jet recording unit and the ink container; and a second filter member arranged in the ink supply passage between the ink discharging ports and the first filter member, the second filter member being provided with a hole which creates a capillary force greater than the negative pressure in the ink container, and to provide an ink jet cartridge provided with such a mechanism, and an ink jet recording apparatus provided with such a mechanism.

DETAILED DESCRIPTION OF THE PREFERRED EMBODIMENTS

Figure 1:
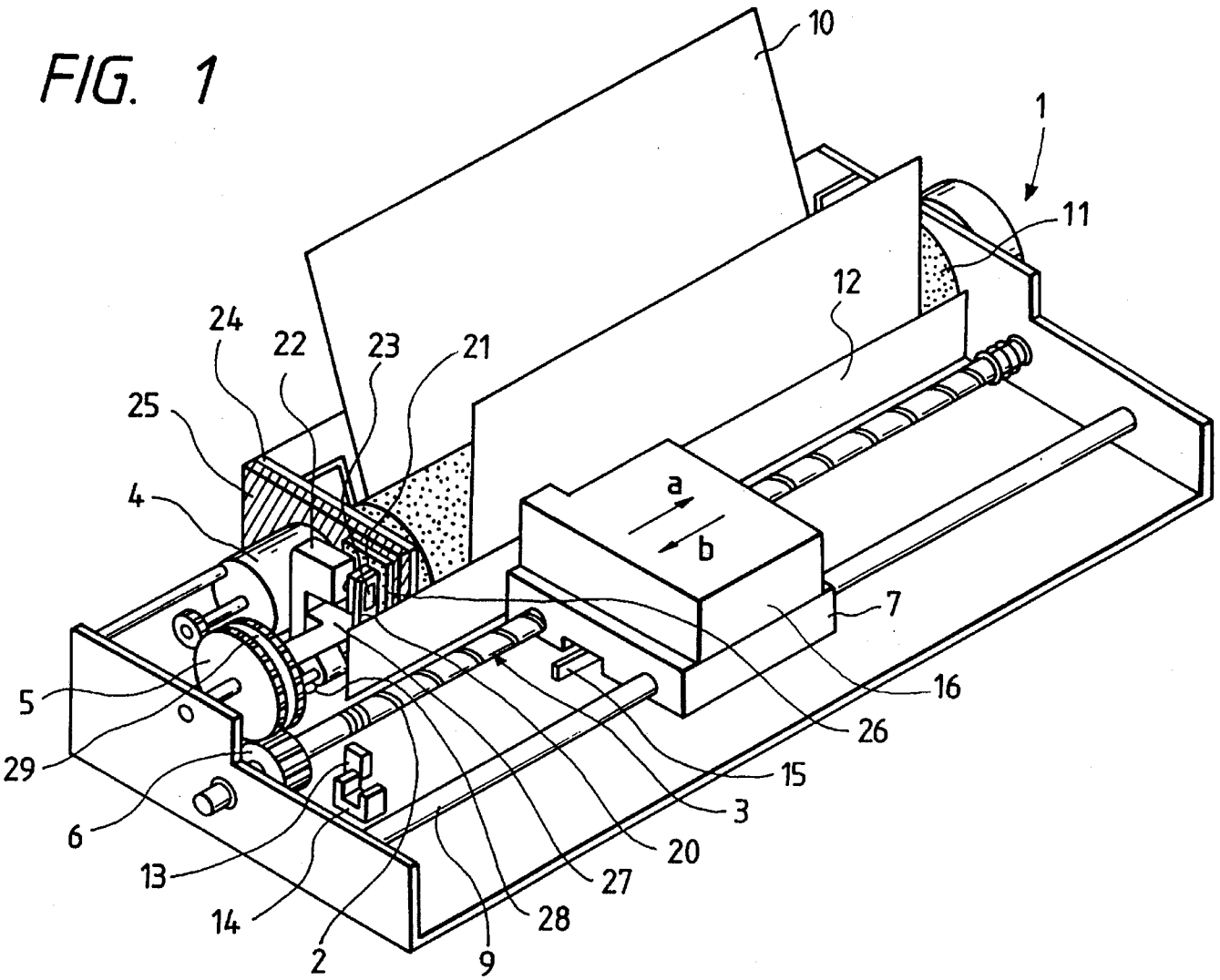
FIG. 1 is a perspective view schematically showing the principal structure of an embodiment of the ink jet recording apparatus to which the present invention is applicable.

Hereinafter, with reference to the accompanying drawings, the description will be made of the embodiments according to the present invention. FIG. 1 is a perspective view schematically showing the structure of an embodiment of the ink jet recording apparatus to which the present invention is applied. In FIG. 1, a lead screw 3 having an inscribed spiral groove 2 is axially and rotatively supported by the main body of the apparatus 1. The lead screw 3 is interlocked with the normal and reverse rotations of a driving motor 4, and is driven and rotated through transmission gears 5 and 6. A carriage 7 fits its pin (not shown) provided on its support 8 (see FIG. 6) in the spiral grove 2. The carriage is also slidably guided by the guide rail 9, thus reciprocating in the directions indicated by arrows a and b by the normal and reverse rotations of the foregoing driving motor 4. A recording material 10 such as sheet or plastic thin plate is fed by a platen roller 11. In the recording position, the recording material is being pressed to the periphery of the platen roller 11 by a sheet pressing board 12 which extends in the traveling direction of the carriage.

Figure 3:
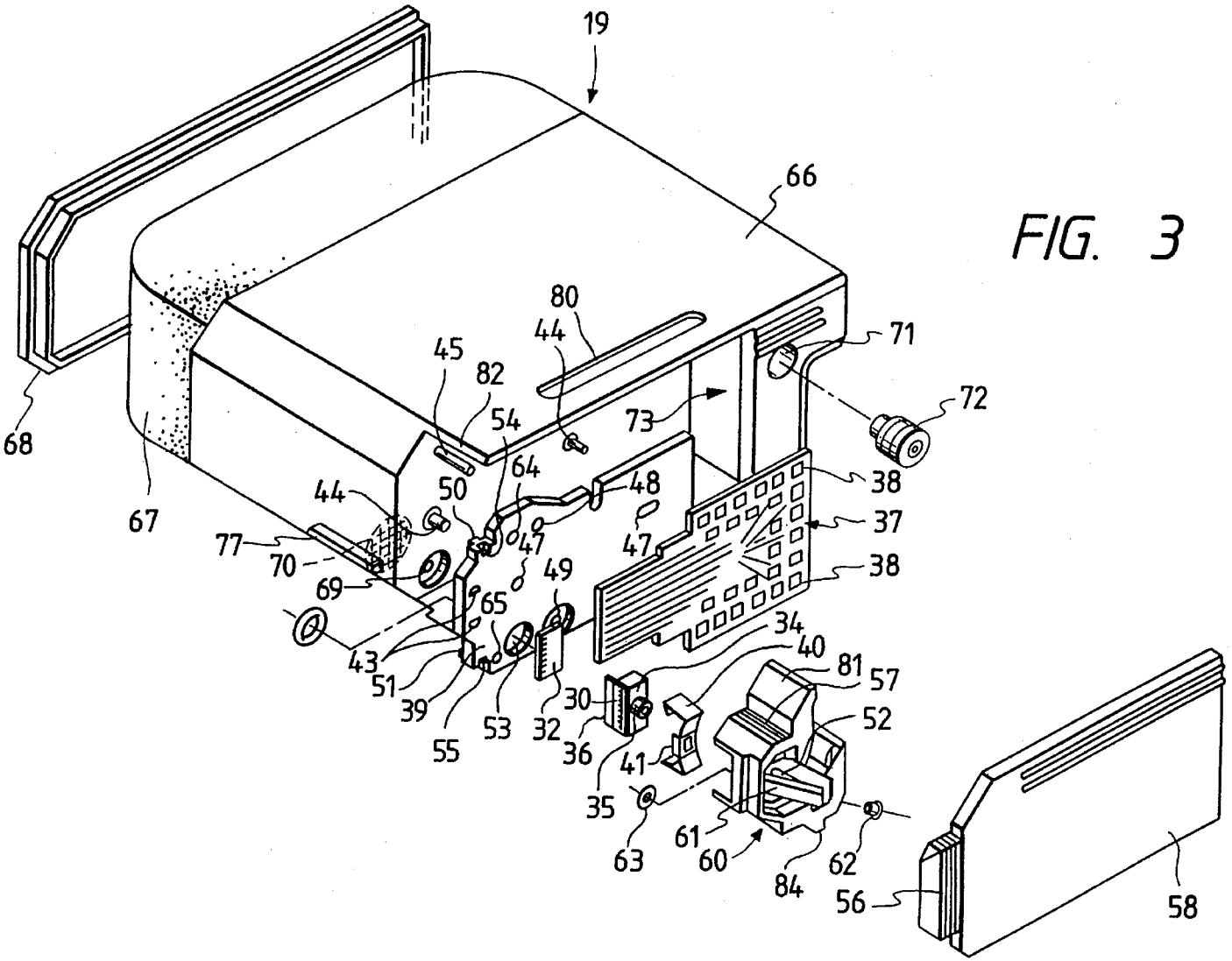
FIG. 3 is a schematically exploded perspective view illustrating the recording means shown in FIG. 2.

Photocouplers 13 and 14 constitute the home position detecting means which confirms the presence of the lever 15 of the carriage 7, and then, causes the rotational direction of the driving motor 4 to be reversed. On the carriage 7, an ink jet cartridge 16 which constitutes recording means is mounted. This ink jet cartridge 16 comprises an ink jet unit 18 including an ink jet head 17 which is integrally formed with an ink tank 19 serving as an ink reservoir as shown in FIG. 3. In a position out of the recording area (the home position, for example), a cap member 20 is arranged to airtightly cover (to execute a capping) the discharging port surface (the front end where the discharging ports are arranged) of the ink jet head 17. This cap member 20 is supported by a supporting member 21 and is also provided with sucking means 22, thus being structured to execute the suction recovery of the ink jet head 17 through the inner aperture 23 in the cap.

On a frame 24 of the main body of the apparatus 1, a supporting board 25 is mounted. A cleaning blade 26 which is slidably supported by the supporting board 25 can travel by a driving means (not shown) in the forward and backward directions with respect to the ink jet head 17. As a cleansing blade 26, it is possible to use the various modes publicly known in addition to the one represented in FIG. 1. A lever 27 is beginning a suction recovery operation and can shift following the movement of a cam 28 which abuts upon the carriage 7. Then, as this lever 27 shifts, a known transmission means comprising a gear 29, a clutching switch, and others is controlled. Hence, the transmission of the driving force from a driving motor 4 is controlled.

Each of the capping, cleaning, and suction recovery processes is executed by the action of the lead screw 3 in the corresponding positions when the carriage 7 arrives in the area on the home position side. Each of these processes is executable in an arbitrary mode by utilizing the known timing and sequence. Also, each of these processes can be implemented independently or complexly.

Figure 2:
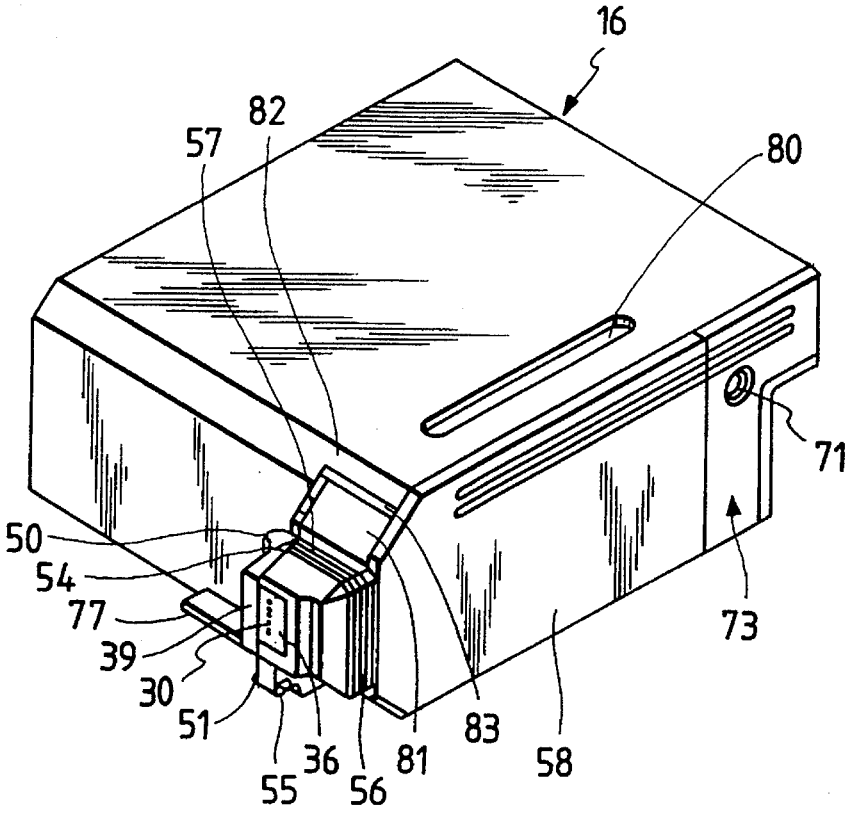
FIG. 2 is a perspective view schematically showing the outer appearance of the recording means shown in FIG. 1.

FIG. 2 is a perspective view showing the outer appearance of the ink jet cartridge 16 shown in FIG. 1. FIG. 3 is an exploded perspective view showing the ink jet cartridge 16. In FIG. 2 and FIG. 3, the ink jet cartridge 16 is of such a structure that the ink jet unit 18 including the ink jet head 17 is integrally fabricated with the ink tank 19 containing ink. In the ink jet head 17, many numbers of discharging ports 30 are also integrally formed. The ink jet unit 18 includes this ink jet head 17 together with the electric wiring and ink tubing to the ink jet head 17 among some others.

The ink jet cartridge 16 according to the present embodiment has a larger ratio of the ink containing portion, and the leading end of the ink jet unit 18 slightly extrudes from the front end of the ink tank 19. This ink jet cartridge (recording means) 16 is of a disposable type, which is detachably and fixedly supported by the carriage 7 through the positioning means and electrical contact of the carriage 7 to be described later in conjunction with FIG. 6.

Figure 4:
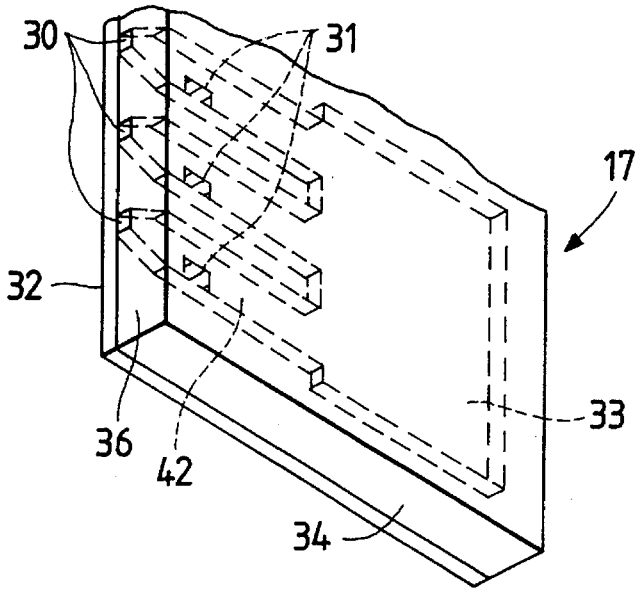
FIG. 4 is a partially perspective view schematically showing the structure of the ink discharging unit of the recording means shown in FIG. 2.

FIG. 4 is a partially perspective view schematically showing the structure of the ink jet head 17. This ink jet head 17 is an ink jet recording head which discharges ink by utilizing thermal energy, and is provided with electrothermal transducers for generating the thermal energy. Also, the ink jet head 17 records by discharging ink from the discharging ports with the utilization of the pressure changes created by the development and contraction of the air bubbles resulting from the film boiling created by the application of the thermal energy from the foregoing electrothermal transducers.

In FIG. 4, the electrothermal transducers are arranged in the liquid passages 42 in the ink jet head 17, respectively, which generate thermal energy when an applied voltage is supplied in order to discharge ink from a plurality of discharging ports 30 arranged in a row. Then, in response to the recording signals from a control circuit (not shown) provided in the main body side of the recording apparatus for giving the head driving signals, each of the electrothermal transducers 31 is driven by the applied driving signal which is selectively supplied, thus enabling the electrothermal transducer 31 to generate the thermal energy for the creation of the film boiling required to form an air bubble in the ink passage 41. With the development of this air bubble, an ink droplet is discharged from the discharging port 30. Each of the electrothermal transducers 31 is provided on a heater board 32 formed on a silicon substrate, and is integrally formed by a film formation technique together with the aluminum wiring and the like (not shown) to supply an electric power to each of the electrothermal transducers 31.

There are integrally formed a grooved ceiling plate 34, with which the partitions to separate a plurality of ink liquid passages 42, and a common liquid chamber 33 and others to contain ink to be supplied to each of the ink passages 42 are formed, respectively; an ink inlet 35 (see FIG. 3) for introducing ink from the ink tank 19 into the common liquid chamber 33; and a discharging port plate (a plate on which the discharging port surface is formed) 36 having a plurality of discharging ports 30 corresponding to each of the ink liquid passages 42. It is preferable to use polysulfone for this integral formation, but it may be possible to use polyether sulfone, polyphenylene oxide, polypropylene, or some other forming resin materials.

Figure 5:
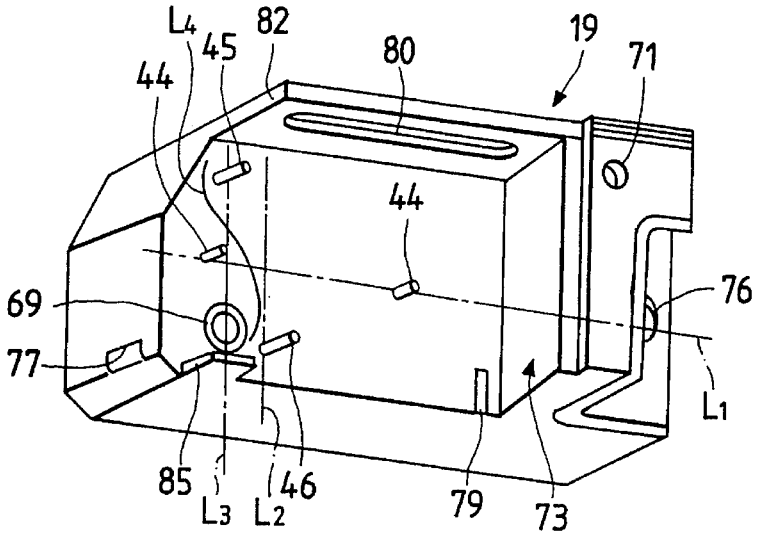
FIG. 5 is a schematically perspective view of the ink tank shown in FIG. 3 which is observed from the ink jet unit mounting side.
Figure 6:
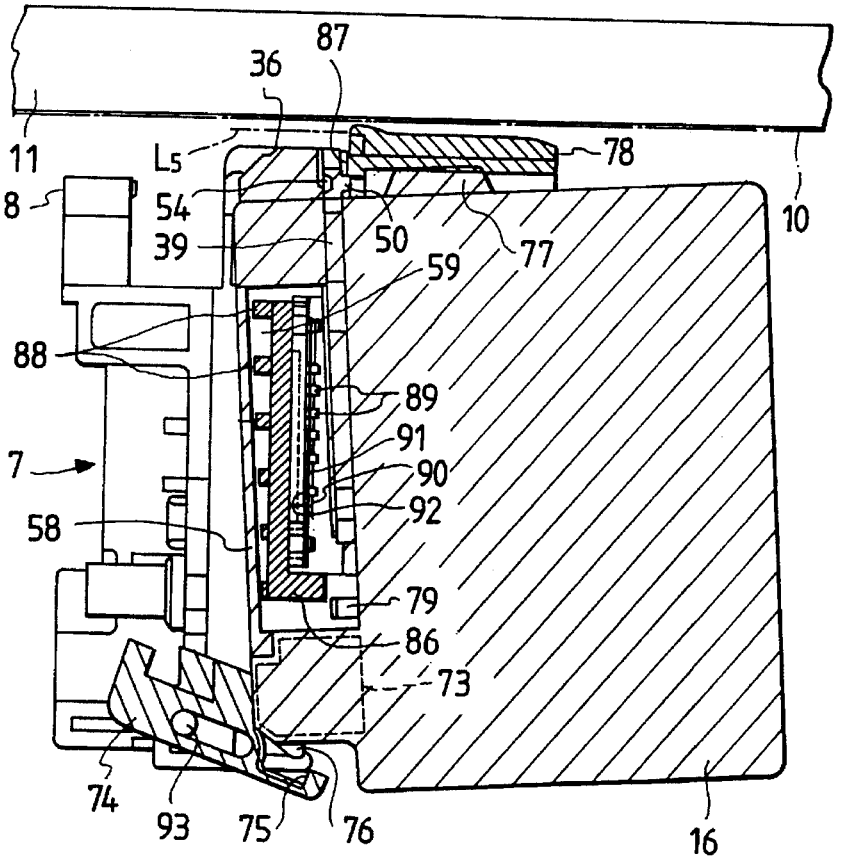
FIG. 6 is a cross-sectional view schematically showing the state of mounting the recording means shown in FIG. 2 to a carriage.

FIG. 5 is a perspective view schematically showing the mounting part of the ink jet unit 18 of the ink tank 19 shown in FIG. 3. FIG. 6 is a cross-sectional view showing the mounting arrangement of the ink jet unit 16 to the carriage 7. Now, mainly with reference to FIG. 3, the description will be made of the structure of the ink jet unit 18 while referring to each of the foregoing drawings as required.

In FIG. 3, the one end of the wiring board 37 and the wiring part of the heater board 32 of the ink jet head 17 are connected to each other. Further, on the other end of the wiring board 37, a plurality of pads 38 are arranged corresponding to each of the electrothermal transducers 31 (see FIG. 4) for receiving the electric signals form the main body of the apparatus. In this way, the electric signals from the main body of the apparatus are each individually supplied to the respective electrothermal transducers 31.

The metallic support 39 which holds the reverse side of the wiring board 37 by its face serves as a bottom board of the ink jet unit 18. A pressure spring 40 is of an M-letter shape, and with the center of the M-letter shape, the spring slightly presses the outer wall portion of the common liquid chamber 33 (see FIG. 4), and at the same time, with its front apron 41, the spring intensively presses a part of liquid passage 42 or preferably the area in the vicinity of the discharging ports 30 linearly. The heater board 32 and ceiling board 34 engage with each other between the feet of the pressure spring 40 when the feet engage with the reverse side of the support 39 through the holes 43 of the support 39, and these boards are fixed under pressure to each other by the intensive biasing forces of the pressure spring 40 and its front apron 41.

The support 39 has the holes 47, 48, and 49 which engage with the two positioning extrusions 44 of the ink tank 19 and the extrusions 45 and 46 (see FIG. 5) for holding the thermal fusion, respectively, and has in addition, the extrusions 50 and 51 on its reverse side for positioning it to the carriage 7. Also, in the support 39, a through hole 53 is provided for the ink supply tube 52 from the ink tank 19. The mounting of the support 39 on the wiring board 37 is executed by an adhesive bonding by an adhesive or the like.

The recesses 54 and 55 of the support 39 are arranged in the vicinity of the foregoing extrusions 50 and 51, respectively, and are positioned on the extended lines of the parallel grooves 56 and 57 which are arranged on the three sides on the circumference of the head unit 18 of the assembled ink jet cartridge 16 (see FIG. 2), thus being structured so that dust particles, ink, and other unwanted substances do not reach the foregoing extrusions 50 and 51. The covering member 58 where the foregoing parallel grooves 56 are formed serves to form the outer wall of the ink jet cartridge 16 as shown in FIG. 6, and at the same time, to form a space 59 between the outer wall and the ink tank 19 in order to mount the ink jet unit 18. Also, the ink supply member 60 where the foregoing parallel grooves are formed is arranged in the form of a cantilever which is fixed on the ink supply tube 52 side, and also, has an ink guide tube 61 which is connected to the foregoing ink supply tube 52. Further, to this member, a sealing pin 62 is inserted to secure the capillary phenomenon between the fixed side of the ink guide tube 61 and the ink supply tube 52. In this respect, the coupling part between the ink tank 19 and ink supply tube 52 is sealed by press fitting. On the end on the ink tank 19 side of the foregoing ink supply tube 52, an intermediate filter 63 is provided.

The forgoing ink supply member 60 is manufactured by a mold formation at a low cost in a high positional precision without lowering the precision required for the fabrication. Further, when fabricated in a large quantity with the arrangement of the ink guide tube 61 of a cantilever structure, it is possible to stabilize the abutting condition of the ink guide tube 61 to the ink inlet 35. In the present embodiment, it is possible to obtain a perfect conductive condition between them reliably just by allowing the sealing adhesive to flow in from the ink supply member 60 side. In this respect, the fixation of the ink supply member 60 to the support 39 can be carried out easily in such a manner that two pins (not shown) arranged on the reverse side of the ink supply member 60 are fitted through the holes 64 and 65 of the support 39, respectively, and then, just thermally bonded. The slight extrusions formed on the reverse side of the surface where these are thermally bonded are received by the recesses (not shown) on the side end of the mounting side of the ink jet unit 18 of the ink tank 19. Therefore, the positioning surface of the ink jet unit 18 can be obtained exactly.

Now, the description will be made of the ink tank 19. The ink tank 19 comprises the main body 66 of the cartridge, an ink absorbent 67, and a covering member 68 fundamentally. After the ink absorbent 67 is inserted into the main body 66 of the cartridge from the side opposite to the ink jet unit 18, this portion is sealed by the covering member 68 to assemble them. The ink absorbent 67 is to be impregnated with ink and hold it, and is arranged in the main body 66 of the cartridge as described above. The ink supply inlet 69 supplies ink to the ink jet unit 18. A filter 70 is provided slightly inside the inlet. Further, an air conduit aperture 71 is arranged in the ink tank 19 to allow the air to be conducted into its interior, and a repellent material 72 is arranged in the interior of the air conduit aperture 71 in order to avoid any ink leakage.

In the ink jet cartridge 16 according to the present embodiment, the rear end of the ink jet head 17 is flattened so that the required space for assembling the head is minimized, and at the same time, a structure is adapted to maximize the volume of the ink to be contained. Therefore, not only it is possible to make the recording apparatus small, but also to reduce the replacement frequency of the cartridge 16. Then, by utilizing the rear part of the space for integrating the ink jet unit 18, an extrusion is formed in this location for the provision of the air conduit aperture 71. The interior of this extrusion is made hollow to provide an air pressure supplying space which matches the entire thickness of the foregoing ink absorbent 67. With the adoption of such a structure as this, it is possible to obtain an excellent ink jet cartridge 16.

In this respect, the air pressure supplying space 73 is much larger than the conventional one, and since the foregoing air conduit aperture 71 is positioned in the upper part thereof, it is possible to retain ink in this air pressure supplying space 73 temporarily even if the ink is parted from the ink absorbent by some abnormality, and then to collect the ink into the absorbent 67 reliably, hence providing an excellent ink jet cartridge 16 which utilizes every part of it without any waste.

Also, the structure of the mounting face of the ink jet unit 18 of the ink tank 19 is shown in FIG. 5. Now, given a straight line running through almost the center of the discharging ports 30 of the discharging plate 36 in parallel with the mounting fiducial plane of the bottom face of the ink tank 19 or the surface of the carriage 7 as $L_1$, the two positioning extrusions 44 and 44 which engage with the two holes 47 of the support 39, respectively, are located above this straight line $L_1$ (see FIG. 5). The heights of these extrusions 44 and 44 are slightly lower than the thickness of the support 39, making it possible to position the support 39. In FIG. 5, on the extension of the straight line $L_1$, a nail 76 is positioned, for engaging with the right-angled engaging surface 75 of the positioning hook 74 of the carriage 7, as shown in FIG. 6. Thus, it is so arranged that the active force exerted to position the carriage 7 works on the surface area in parallel with the above-mentioned fiducial plane including the foregoing straight line $L_1$ (see FIG. 5). As described later, these relations present an effective structure in terms of making the positioning precision merely for the ink tank 19 as equally accurate as that of the discharging ports 30 of the ink jet head 17.

Also, the extrusions 45 and 46 (FIG. 5) of the ink tank 19, which respectively correspond to the holes 48 and 49 (FIG. 3) provided for the support 39 to be fixed to the side face of the ink tank 19, are longer than the foregoing extrusions 44 and 44, and the extruded portions penetrated through the support 39 are thermally bonded in order to fix the support 39 to the side face. Now, given a straight line orthogonal to the foregoing straight line as $L_1$ and running through the foregoing extrusion 45 as $L_3$, and a straight line running through the foregoing extrusion 46 as $L_2$, the substantial center of the ink supply inlet 69 (FIG. 3) is positioned on the straight line $L_3$. Therefore, the coupling state of the ink supply inlet 69 and the ink supply tube 52 is stabilized, and the load to the coupling state is reduced even when dropped or an impact is given.

Also, the straight line $L_2$ and the straight line $L_3$ do not agree, and since the extrusions 45 and 46 are present in the vicinity of the extrusion 44 on the discharging port 30 side of the ink jet head 17, it will produce further enforcement effects on positioning the ink jet head 17 with respect to the ink tank 19. In this respect, a straight line $L_4$ in FIG. 5 represents the position of the outer wall of the ink supply member 60 when mounted. As the foregoing extrusions 45 and 46 are arranged along this straight line $L_4$, these extrusions give a sufficient strength and positioning precision with respect to the weight on the structure of the ink jet head 17 on its leading end side. The front flange 77 of the ink tank 19 is inserted into the hole of the front plate 78 of the carriage 7 (see FIG. 6) for the purpose of counteracting such an abnormality as the disposition of the ink tank 19 is extremely great.

A stopper 79 (see FIG. 6) is provide on the bar (not shown) of the carriage 7 for preventing the carriage 7 from dropping off. This constitutes a protective member such that when the ink jet cartridge 16 advances beneath the bar in the position where it is rotated and mounted as described later, the mounting state can be maintained even if the force is exerted upward which may cause the cartridge to be off from the set position unnecessarily.

The ink tank 19 is formed to enclose the ink jet unit 18 by covering the tank with the covering member 58 after the ink jet unit 18 is installed with the exception of its lower aperture. The ink jet cartridge 16 formes a space, the four sides of which are essentially enclosed because the foregoing lower aperture provided for mounting it on the carriage 7 is located close to the carriage 7. Therefore, the heat from the ink jet head 17 which is retained in this enclosed space serves effectively to make this space a heat retaining space. Nevertheless, when the apparatus is continuously used for a long time, this condition will, though slightly, cause the temperature rise. In the present embodiment, therefore, a slit (aperture) 80 is arranged on the upper surface of the ink jet cartridge 16 in a width narrower than the foregoing enclosed space in order to promote the natural heat radiation of the support 39. By the provision of this slit 80, it is possible to implement an even distribution of temperature in the ink jet unit 18 as a whole without being affected by the environmental conditions while avoiding the foregoing temperature rise.

When the ink tank is assembled as the ink jet cartridge 16, ink is supplied from the interior of the main body 66 of the cartridge to the interior of the ink supply member 60 through the ink supply inlet 69, the hole 53 of the support 39, the leading-in port provided on the reverse side in the ink supply member 60, and then, through the interior of the ink supply member 60, the ink flows in the common liquid chamber 33 (see FIG. 4) from the leading-out port of the ink supply member 60 through an appropriate supply tube and the ink receptacle 35 of the ceiling plate 34. The junctions of the ink flow in the above-mentioned passage are sealed by a silicon rubber, butyl rubber, or some other packing or by the application of press fitting, respectively, thus securing the ink supply passage in such a sealed structure as this.

As described above, each of the ink supply member 60, the ceiling plate 34 and discharging port plate 36, and the main body 66 of the cartridge is formed as one integrated component, respectively. Therefore, not only do these components enable the assembling to be executed in a high precision, they also effectively contribute to improving the quality in a large scale production. Also, as the part numbers are reduced as compared to the conventional apparatus, it is easier to obtain and demonstrate the excellent characteristic properties reliably as desired. Further, in the present embodiment, an interval 83 exists between the upper surface 81 of the ink supply member 60 and the end portion 82 of the ceiling member where the elongated thin aperture (slit) 80 is formed for the ink tank 19 as shown in FIG. 2. Likewise, an interval (not shown) is formed between the bottom face 84 (FIG. 3) of the ink supply member 60 and the end portion 85 of a lower thin board on the head side where the covering member 68 of the ink tank 19 is bonded.

These intervals contribute to the further promotion of the heat radiation of the above-mentioned aperture 80, and at the same time, to the prevention of any unwanted force from acting directly on the ink supply member 60 even if such a force is exerted on the ink tank 19, that is, to the prevention of such a force from acting on the ink jet unit 18 ultimately. In any case, the above-mentioned structure of the present embodiment is not available in the conventional example. While each of the components efficiently produces a remarkable effect by itself, this structure will demonstrate particular effects when each of them is combined together.

Now, mainly referring to FIG. 6, the mounting of the ink jet cartridge 16 to the carriage 7 will be described. In FIG. 6, the platen roller 11 guides a recording material (a recording sheet, for example) 10 in the direction toward the surface of FIG. 6 from the rear side thereof. The carriage 7 travels in the longitudinal direction (axial direction) of the platen roller 11. The carriage 7 is provided with a front plate 78 (2 mm thick, for example) positioned in front of the carriage 7, that is, the front side of the ink jet cartridge 16 on the platen roller 11 side; an electrical connection supporting board 86 which will be described later; and a positioning hook 74 for fixing the ink jet cartridge 16 in a given recording position.

The front plate 78 has two positioning extrusion surfaces 87 fitting to the extrusions 50 and 51 (FIG. 3) of the support 39 of the ink jet cartridge 16 in order to receive the vertical force through these extruded surfaces 87 after the ink jet cartridge 16 is installed. To this end, a plurality of ribs (not shown) are provided on the platen roller 11 side of the front plate 78 to face in the direction of the vertical force. These ribs slightly extrude (approximately 0.1 mm, for example) toward the platen roller 11 side from the front position $L_5$ when the ink cartridge 16 is installed, hence dually serving as the head protection extrusions.

The supporting board 86 has a plurality of reinforcement ribs 88 extending vertically to the surface of FIG. 6. The heights of these ribs 88 are gradually lowered in the direction from the platen roller 11 side to the hook 74 side. With this arrangement, the ink jet cartridge 16 can be installed in a inclined state as shown in FIG. 6. Also, the supporting board 86 supports a flexible sheet 90 having pads 89 corresponding to the pads 38 (FIG. 3) of the wiring board 37 (FIG. 3) of the ink jet cartridge 16 as well as a rubber pad sheet 91 having the dots which create the resilient force which presses each of the pads 89 from the rear side.

In order to stabilize the state of the electrical connection between the pads 38 and the pads 89, the supporting board 86 is provided with a positioning surface 92 on the hook 74 side in order to exercise the active force to the ink jet cartridge 16 in the direction opposite to the active direction of the extruded surface 87, hence forming a pad contacting area between them, and at the same time, uniformly regulating the deformation amount of the dots of the dotted rubber sheet 91 which correspond to the pads 89. The positioning surface 92 abuts upon the wiring board 37 (FIG. 3) when the ink jet cartridge 16 is fixed to the recordable position. The pads 38 are distributively arranged to be symmetrical to the aforesaid straight line $L_1$ (see FIG. 5). Therefore, the deforming amount of each dot of the dotted rubber pad sheet 91 becomes uniform to make the contact pressure between the pads 89 and pads 38 further stabilized. In the present embodiment, the pads 38 are distributed in two rows for upper and lower each, and two vertical rows.

In FIG. 6, the hook 74 has an elongated hole which engages with the fixed shaft 93, and by utilizing the space of this elongated hole in which it can shift itself, the hook rotates in the counterclockwise direction, and then, shifts to the left side toward the longitudinal direction of the platen roller 11 for the positioning of the ink jet cartridge 16 to the carriage 7. The movement of the hook 74 can be arranged in any way, but it is preferable to adopt a structure which allows the use of a lever or the like. In any case, when this hook 74 rotates, the ink jet cartridge 16 is being shifted to the platen roller 11 side, and the positioning extrusions 50 and 51 move to a position where these extrusions can abut upon the extruded face of the front plate 78. By the hook 74 which has shifted to the left side, the right-angled hook surface 75 is being in close contact with the right-angled surface of the nail 76 of the ink jet cartridge 16, and the ink jet cartridge 16 rotates in the plane around the contacting area between the extrusions 50 and 51 and the extruded surface 87, thus enabling the pads 38 and pads 89 to start contacting each other ultimately.

Then, when the hook 74 is held at a given position, that is, a position where it is fixed, there are formed simultaneously the complete contact between the pads 38 and pads 89; the complete surface contact between the extrusions 50 and 51 and the extruded surface 87; the interfacial contact between the hook surface 75 and the right-angled surface of the nail 76; and the surface contact between the wiring board 37 (FIG. 3) and the positioning surface 92. Hence, the positioning of the ink jet cartridge 16 is completed and maintained with respect to the carriage 7.

Figure 7:
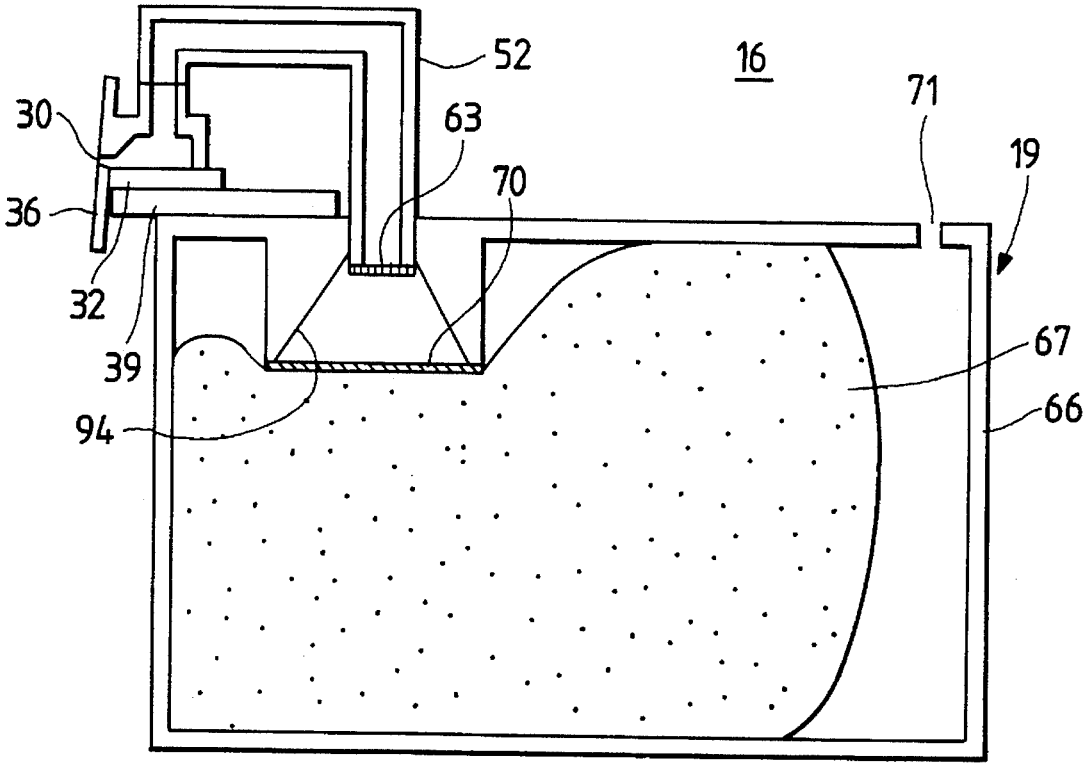
FIG. 7 is a vertical section schematically showing a first embodiment of the ink supply system of the ink jet recording apparatus to which the present invention is applicable.

FIG. 7 is a vertical section schematically showing a first embodiment of the ink supply system of the ink jet recording apparatus to which the present invention is applicable. In FIG. 7, an intermediate filter 63 is thermally bonded to the end of the ink supply tube 52 on the ink tank 19 side. Further, a filter 70 which abuts on the ink absorbent 67 is thermally bonded to the ink leading-out port 94 of the ink tank 19. Then, it is defined that the volume $V_A$ (the volume of the part where the ink is filled in) from the discharging ports 30 of the ink jet head 17 to the aforesaid intermediate filter 63 and the volume $V_B$ from the intermediate filter 63 to the filter on the ink leading-out port 94 are substantially equal to each other.

The mesh size of each of the filters 63 and 70 are defined as given below. In other words, for the intermediate filter 63, holes of approximately several tens of microns each are formed in the form of cells. The capillary force of the cells for ink is greater than the negative pressure in the ink tank 19. It is also arranged to make the resistance extremely small when the ink flows through the filter. On the other hand, for the filter 70 provided for the ink leading-out port 94, the mesh size is defined to be just good enough to hold dust particles of approximately 10 microns or more at the sacrifice of a slight flow resistance to be created.

Also, regarding the areas of each of the filters 63 and 70, whereas the diameter of the intermediate filter 63 may be approximately 2 mm so as to maintain an ink meniscus in the ink flow path in a case of a monochromatic head having 64 discharging ports 30 driven by 6 KHz, for example, the minimum diameter of the filter 70 at the ink leading-out port 94 should be three to six times, preferably four to five times as large as the diameter of the intermediate filter, that is, selected to be of 6 mm diameter or more in order to facilitate refilling of ink consumed for discharge. Further, the distance between the intermediate filter 63 and the filter 70 is determined by a value of the volume $V_B$ set in view of relation between the volumes $V_A$ and $V_B$.

It is extremely important to execute a proper selection of the filter mesh sizes for each of the filters 63 and 70 and a proper setting of the distance between both filters 63 and 70. These should be designed carefully. In this case, the recovery amount for the head recovery process of the recording apparatus should be good enough if such an amount is a volume which is more than the volume between the discharging ports 30 and the intermediate filter 63 or between the intermediate filter 63 and the filter 70 at the ink leading-out port 94, whichever is greater. The reason is that even in a state where no ink exists at all in the liquid passage from the ink leading-out port 94 to the discharging ports 30, the ink can be raised by the first-time recovery operation at least to the surface of the intermediate filter 63 from the surface of the filter 70, and then, by the next recovery operation, the ink can be induced at least to the discharging ports 30 from the intermediate filter 63.

At this time, a volume between the discharging port 30 of the ink jet head 70 and the intermediate filter 63 is substantially equal to a volume between the intermediate filter 63 and the filter 70 of the ink leading out port 94 so that the recovery amount by pump suction can be minimized.

However, in fact, the volume $V_B$ is slightly less than the volume $V_A$. Preferably a value of the volume $V_B$ is more than or equal to 90% and less than or equal to 95% of a value of the volume $V_A$. Because ink can be securely sucked to the intermediate filter 63 by one recovery operation when ink remain in the ink tank 19 decreases. In this case the recovery amount by one recovery operation of a pump may be the volume $V_A$.

With the filters set as above, it is possible to execute a recovery operation with approximately half an amount (½) per time as compared to the conventional example in which no intermediate filter 63 is employed. In addition, the ink drop which tends to occur in a normal condition of use (the phenomenon that ink runs backward) can be held by the intermediate filter 63, thus making it possible to recover this condition just by a one-time recovery operation. Conversely speaking, by the provision of the intermediate filter 63, the volume between the discharging ports 30 and the filter 70 at the ink leading-out port 94 can be doubled (that is, the leading-out port 94 can be doubled, that is, the recovery amount equivalent to the volume twice as much can be secured. In this way, it becomes possible to reduce the flow resistance by making the effective area of the filter 70 at the ink leading-out port 94, and to arrange it as an ink supply system suitable for a high-speed recording.

In other words, just by making the number of the recovery operation two times, that is, [the number of the intermediate filter 63+1] in a recording apparatus having a usual recording speed, it is possible to execute the recovery process reliably using the foregoing ink supply system even when a recording head requiring a large recovery amount is used as in a high-speed recording or the like. Therefore, it is possible to provide an ink jet apparatus capable of establishing the compatibility of the recovery amount between a usual recording head and a high-speed type recording head, and using a high-speed type recording head in a usual recording arrangement as well as improving the ink usage efficiency in the recovery process.

Figure 8:
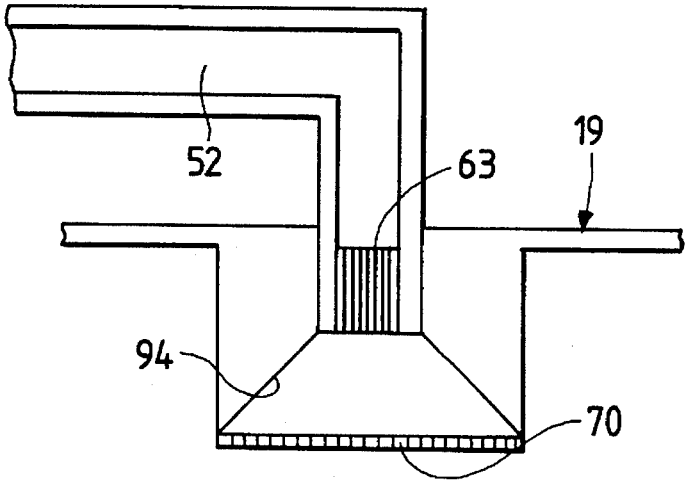
FIG. 8 is a schematically vertical section partially showing the principal structure of a second embodiment of the ink supply system of the ink jet recording apparatus to which the present invention is applicable.

FIG. 8 is a partially vertical section schematically showing the principal structure of a second embodiment of the ink supply system of the ink jet recording apparatus to which the present invention is applied. The aforesaid intermediate filter 63 may be the one which can create the capillary force which is stronger than the negative pressure in the ink tank 19. Therefore, it may be possible to form this filter in the mesh type other than that described above. Here, in the second embodiment shown in FIG. 8, the intermediate filter 63 is formed by an aggregate of fine pipes. Any other parts than this structure in the present embodiment are essentially the same as those in the first embodiment shown in FIG. 7. Each of the corresponding parts are designated by the same reference marks, and the description thereof will be omitted.

Figure 9:
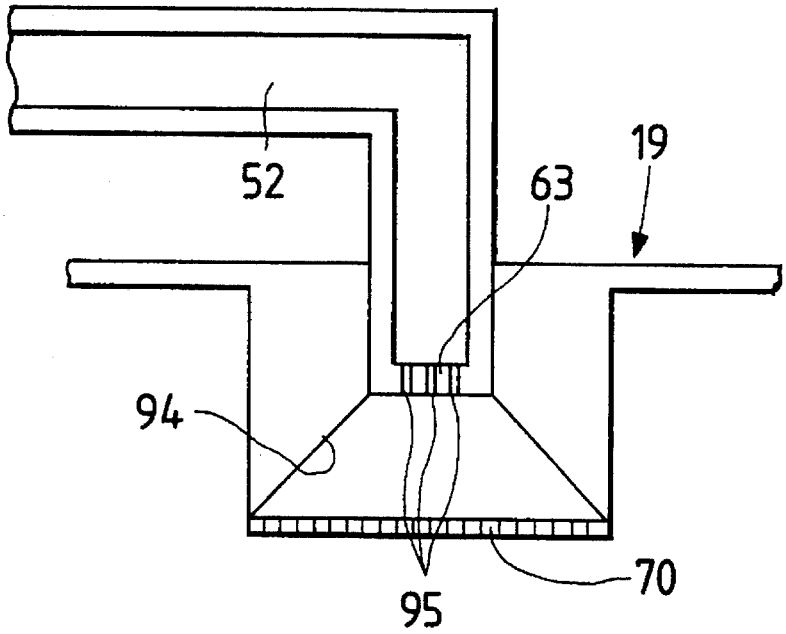
FIG. 9 is a schematically vertical section partially showing the principal structure of a third embodiment of the ink supply system of the ink jet recording apparatus to which the present invention is applicable.

FIG. 9 is a partially vertical section schematically showing the principal structure of a third embodiment of the ink jet recording apparatus to which the present invention is applicable. In the present embodiment, the intermediate filter 63 is structured by integrally forming the wall portion which has a plurality of fine holes 95 on the end portion of the ink supply tube 52. Any other parts than this structure in the present embodiment are essentially the same as those in the first embodiment shown in FIG. 7. Each of the corresponding parts are designated by the same reference marks, and the description thereof will be omitted. With the structures shown in FIG. 8 or FIG. 9, it is possible to achieve the same effects as in the first embodiment set forth above.

Figure 10:
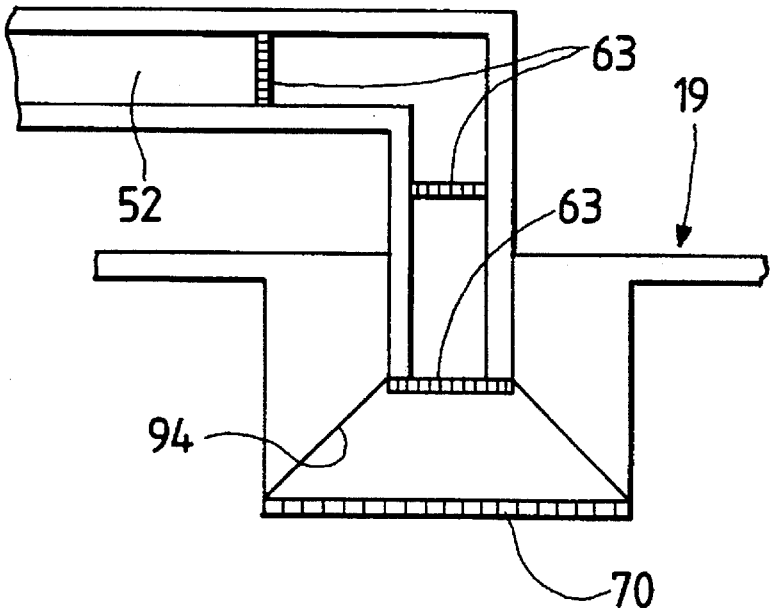
FIG. 10 is a schematically vertical section partially showing the principal part of another structural example of the ink supply system of the ink jet recording apparatus to which the present invention is applicable.

Also, in each of the foregoing embodiments, the description has been made of the case where only one intermediate filter 63 is arranged, but it may be possible to embody the present invention with a structure providing two or more intermediate filters 32. In such a case, the recovery amount is defined for a value greater than the volume each separated by the respective intermediate filters 63. Also, the one-time recovery amount can be just about one over a portion of the recovery operation. FIG. 10 is a partially vertical section showing the principal part of the ink supply system in which the intermediate filters 63 are provided at plural locations (three locations). With an arrangement of plural intermediate filters 63 such as this, it is possible to obtain the same effects as in the first embodiment set forth above.

According to the embodiments described above, it becomes possible to mount the recording means (an ink cartridge or the like) which requires a large amount of recovery amount in total in a recording apparatus whose recovery amount per time is small, to maintain the compatibility for eliminating the restriction brought about by the limited recovery amount, to increase the possibility that the same recording head can be used in different recording apparatuses, and to enhance the production efficiency (more varieties in a small quantity each→limited varieties in a large quantity each) of recording means such as the ink jet cartridge. Also, in a recording apparatus, the recovery amount can be set at a constant value, which in turn improves the efficiency of design and fabrication. Further, even in the recording means (ink cartridge or the like) which requires a large recovery amount in total, it is possible to execute a usual recovery with a small recovery amount so that the wasteful consumption of ink can be reduced, hence improving the ink usage efficiency for recording.

With the adoption of a droplet discharging device to which such an invention as this is applicable, it is possible to demonstrate more efficiently the effects of the present invention, namely, the compatibility of the recovery amount between a usual recording head and a high-speed type recording head; the use of a high-speed type recording head in a usual recording apparatus; and the improvement of the ink usage efficiency in the recovery process.

In this respect, each of the foregoing embodiments has been described by exemplifying a case of a serial type recording apparatus in which the recording head 16 is mounted on the carriage 7, but the present invention is equally applicable to a recording apparatus in which a line type recording head is used, which has a length to cover the width of a recording material totally or locally. Also, in the foregoing embodiments, the case is exemplified, in which the recording is executed by one recording head 16. However, the present invention is widely applicable to a color ink jet recording apparatus using a plurality of recording heads for the execution of recording in different colors; to an ink jet recording apparatus for the gradational recording using a plurality of recording heads for the execution of recording in a monochrome ink but having different densities; or to some others irrespective of the number of recording heads and recording colors while obtaining the same effects.

Furthermore, in addition to the use of the exchangeable ink jet cartridge 16 which is integrally formed by a recording head and an ink tank as described above, the present invention is equally applicable to a recording apparatus in which the recording head and ink tank are individually formed and are connected by a tube and others, or to some other type irrespective of the arrangement mode of the recording head and ink tank while obtaining the same effects.

In this respect, the present invention is applicable to an ink jet recording apparatus using the recording means (recording head) which employs electro-mechanical transducers such as piezoelectric elements. However, the present invention is particularly effective in applying it to an ink jet recording apparatus of a type which discharges ink by the utilization of thermal energy, and produces excellent effects because with such a type of recording it is possible to attain a highly densified recording as well as a highly precise and fine recording.

Regarding the typical structure and operational principle of such a type, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system. Particularly, however, it is suitable for the on-demand type because the principle is such that at least one driving signal, which provides a rapid temperature rise beyond a departure from nucleation boiling point in response to recording information, is applied to an electrothermal transducer disposed on a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid (ink) one to one for each of the driving signals.

By the development and contraction of the bubble, the liquid (ink) is discharged through a discharging port to produce at least one droplet. The driving signal is preferably in the form of pulses because the development and contraction of the bubble can be effectuated instantaneously, and, therefore, the liquid (ink) is discharged with quick response. The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducers as disclosed in the above-mentioned patents (linear type liquid passage or right angle liquid passage). Besides, the structure such as disclosed in the specifications of U.S. Pat. Nos. 4,558,333 and 4,459,600 wherein the thermal activation portions are arranged in a curved area is also included in the present invention. In addition, the present invention is effectively applicable to the structure disclosed in Japanese Patent Laid-Open Application No. 59-123670 wherein a common slit is used as the discharging ports for plural electrothermal transducers, and to the structure disclosed in Japanese Patent Laid-Open Application No. 59-138461 wherein an opening for absorbing pressure waves of the thermal energy is formed corresponding to the discharging ports. In other words, these applications are possible because recording can be executed reliably and effectively according to the present invention irrespective of the modes of the recording head.

Moreover, as described earlier, the present invention is effectively applicable to a full-line type recording head having the length corresponding to the maximum width of a recording material (recording medium) recordable by the recording apparatus. Such a recording head may be the one structured by combining a plurality of the recording heads or a single full-line recording head which is integrally formed. In addition, the present invention is effectively applicable to a serial type recording head as exemplified above; a recording head fixed to the main body of an apparatus; a replaceable chip type recording head for which the electrical connection with the main apparatus and the ink supply become possible when this chip is mounted in the main body of the apparatus; or to a cartridge type recording head having an ink tank integrally provided for the head itself.

Also, it is preferable to additionally provide the recording head recovery means and preliminarily auxiliary means as constituents of the recording apparatuses of the present invention because these additional means will contribute to enabling the effectiveness of the present invention to be more stabilized. To name them specifically, such constituents are capping means for the recording head, cleaning means, compression or suction means, preliminary heating means such as electrothermal transducers or heating elements other than such transducers or the combination of those types of elements. It is also possible to contribute to the effectiveness of the present invention in terms of a stabilized recording by utilizing a preliminary discharge mode, aside from the regular discharging for recording.

Also, as described earlier, regarding the kinds or the number of the mounting recording heads, the present invention is extremely effective in applying it not only to a recording mode in which only a main color such as black or the like is used, but also to an apparatus having at least one of a multi-color mode with ink of different colors, or a full-color mode using the mixture of the colors, irrespective of whether the recording heads are integrally structured or structured by a combination of plural recording heads.

Furthermore, in the embodiments according to the present invention set forth above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable discharge in general, the ink may be such that it can be liquefied when the applicable recording signals are given. In addition, while positively preventing the temperature rise due to the thermal energy by the use of such energy as an energy consumed for changing states of ink from solid to liquid, or using the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium.

In such a case, it may be possible to retain the ink in the form of liquid or solid in the recesses or through holes of a porous sheet such as disclosed in Japanese Patent Laid-Open Application No. 54-56847 or No. 60-71260 in order to enable the ink to face the electrothermal transducers. In the present invention, the most effective method for the various kinds of ink mentioned above is the one capable of implementing the film boiling method as described above.

Moreover, as the mode of the recording apparatus according to the present invention, it may be possible to adopt a copying apparatus combined with a reader in addition to the image output terminal which is integrally or independently provided for a word processor, computer, or other information processing apparatus, and further, it may be possible to adopt a mode of a facsimile apparatus having transmission and reception functions.

In other words, with the structure of each of the above-mentioned embodiments, it is possible to define each volume between the ink discharging ports and an intermediate filter, and between the intermediate filter and the filter at the ink leading-out port substantially equal to the recovery volume between the conventional ink discharging port and the filter, respectively. Hence, it becomes possible to design the area of the filter at the ink leading-out to be large. For example, even when ink in the part up to the ink tank (ink reservoir) turns back due to the fact that the recording head is left intact for a long time or the ink drop (reverse flow of ink) in the recording head occurs, among others, it is possible to recover the recording head by a two-time recovery operation with the provision of one intermediate filter. This means that by the first-time recovery operation the ink is raised to the intermediate filer, and then, by the second-time recovery operation, the ink is raised to the discharging ports. Moreover, the ink drop (reverse flow of ink) which tends to occur in the usual state of use stops at the location where the intermediate filter is arranged. Therefore, this can be recovered by a one-time recovery operation. In this way, with the provision of the intermediate filter, it becomes possible to recover a recording head which requires a large recovery amount (such as a head of a high-speed type) by increasing the number of recoveries (the number of intermediate filters+1) to cover such an increased amount even in a usual recording apparatus which provides only a small recovery amount. In a case of a usual recording head, it is also possible to recover it by a small recovery amount (one-time recovery).

As clear from the above descriptions, according to the examples embodying the present invention, a structure is arranged to provide an intermediate filter having holes which are good enough to create the capillary force greater than the negative pressure in the ink reservoir portion between the ink discharging ports of a recording means and the ink leading-out port of the ink reservoir portion, thus making it possible to provide an ink jet recording apparatus capable of making the recovery amount compatible between a usual recording means and a recording means of a high-speed type; of making a recording means of a high-speed type usable in a usual recording apparatus; and of improving the ink usage efficiency in the recovery process.

What is claimed is:

1. An ink supply mechanism for supplying ink from an ink reservoir portion for storing ink to an ink jet recording portion having an ink discharging port for discharging ink, said mechanism comprising:

an ink outlet section provided in said ink reservoir portion, said ink outlet section having an ink leading port for supplying ink to said ink jet recording portion;

a first filter member provided in said ink outlet section, within said ink leading port;

an ink supply member for communicating said ink jet recording portion with said ink outlet section for supplying ink from said ink reservoir portion to said ink jet recording portion; and a second filter member provided at an end of said ink supply member adjacent said ink reservoir portion and between the ink discharging port and said first filter member, said second filter member being provided in said ink leading port and creating a capillary force greater than a negative pressure in said ink reservoir portion, wherein an effective area of said first filter member is larger than an effective area of said second filter member and a volume between said discharging port and said second filter member is no less than or substantially equal to a volume between said first filter member and said second filter member.

2. An ink supply mechanism according to claim 1, wherein the volume from said ink discharging port to said second filter member and the volume from said second filter member to said first filter member is substantially equal.

3. An ink supply mechanism according to claim 1, wherein the volume between the second filter member and the first filter member is more than or equal to 90% and less than or equal to 95% of the volume between the ink discharge port and the second filter member.

4. An ink supply mechanism according to claim 1, wherein a diameter of the first filter member is more than or equal to three times and less than or equal to six times as large as a diameter of the second filter member.

5. An ink supply mechanism according to claim 1, wherein a plurality of filter members different from said first filter member are provided in said ink supply member between said ink discharging port and said first filter member.

6. An ink supply mechanism according to any one of claims 1 to 5, wherein said second filter member comprises an aggregate of pipe members.

7. An ink supply mechanism according to any one of claims 1 to 5, wherein said second filter member comprises a wall portion having a plurality of holes integrally formed on the end of the ink supply member adjacent said ink reservoir portion.

8. An ink supply mechanism according to any one of claims 1 to 5, wherein said ink jet recording portion comprises an ink jet recording head provided with electrothermal transducers generating thermal energy utilized for discharging ink.

9. An ink supply mechanism according to claim 8, wherein said ink jet recording head discharges ink from the ink discharging port by utilizing film boiling created by the thermal energy generated by said electrothermal transducers.

10. An ink jet cartridge provided with an ink reservoir portion for storing ink, an ink jet recording portion having an ink discharging port, and an ink supply mechanism for supplying ink from said ink reservoir portion to said ink jet recording portion, said cartridge comprising:

an ink outlet section provided in said ink reservoir portion, said ink outlet section having an ink leading port for supplying ink to said ink jet recording portion;

a first filter member provided in said ink outlet section, within said ink leading port;

an ink supply member for communicating said ink jet recording portion with said ink outlet section for supplying ink from said ink reservoir portion to said ink jet recording portion;

a second filter member provided at an end of said ink supply member adjacent said ink reservoir portion and between the ink discharging port and said first filter member, said second filter member being provided in said ink leading port and creating a capillary force greater than a negative pressure in said ink reservoir portion, wherein an effective area of said first filter member is larger than an effective area of siad second filter member and a volume between said discharging port and said second filter member is no loess than or substantially equal to a volume between said frist filter member and said second filter member; and a driving signal receiving portion for receiving driving signals for said ink jet recording portion to cause said ink jet recording portion to discharge ink from said ink discharging port.

11. An ink jet cartridge according to claim 10, wherein the volume from said ink discharging port to said second filter member and the volume from said second filter member to said first filter member is substantially equal.

12. An ink jet cartridge according to claim 10, wherein the volume between the second filter member and the first filter member is more than or equal to 90% and less than or equal to 95% of the volume between the ink discharge port and the second filter member.

13. An ink jet cartridge according to claim 10, wherein a diameter of the first filter member is more than or equal to three times and less than or equal to six times as large as a diameter of the second filter member.

14. An ink supply jet cartridge according to claim 10, wherein a plurality of filter members different from said first filter member are provided in said ink supply member between said ink discharging port and said first filter member.

15. An ink jet cartridge according to any one of claims 10 to 14, wherein said second filter member comprises an aggregate of pipe members.

16. An ink jet cartridge according to any one of claims 10 to 14, wherein said second filter member comprises a wall portion having a plurality of holes integrally formed on the end of the ink supply member adjacent said ink reservoir portion.

17. An ink jet cartridge according to any one of claims 10 to 14, wherein said ink jet recording portion comprises an ink jet recording head provided with electrothermal transducers generating thermal energy utilized for discharging ink.

18. An ink jet cartridge according to claim 17, wherein said ink jet recording head discharges ink from the ink discharging port by utilizing film boiling created by the thermal energy generated by said electrothermal transducers.

19. An ink jet recording apparatus provided with an ink supply mechanism for supplying ink from an ink reservoir portion for storing ink to an ink jet recording portion having an ink discharging port, said apparatus comprising:

a mounting portion for mounting the ink jet recording portion;

a head driving signal providing portion for generating a driving signal to drive said ink jet recording portion;

an ink outlet section provided in said ink reservoir portion, said ink outlet section having an ink leading port for supplying ink to said ink discharging portion;

a first filter member provided in said ink outlet section, within said ink leading port;

an ink supply member for communicating said ink jet recording portion with said ink outlet section for supplying ink from said ink reservoir portion to said ink jet recording portion; and a second filter member provided at an end of said ink supply member adjacent said ink reservoir portion and between the ink discharging port and said first filter member, said second filter member being provided in said ink leading port and creating a capillary force greater than a negative pressure in said ink reservoir portion, wherein an effective area of said first filter member is larger than an effective area of said second filter member and a volume between said discharging port and said second filter member is no less than or substantially equal to a volume between said first filter member and said second filter member.

20. A ink jet recording apparatus according to claim 19, wherein the volume from said ink discharging port to said second filter member and the volume from said second filter member to said first filter member is substantially equal.

21. An ink jet recording apparatus according to claim 19, wherein the volume between the second filter member and the first filter member is more than or equal to 90% and less than or equal to 95% of the volume between the ink discharge port and the second filter member.

22. An ink jet recording apparatus according to claim 19, wherein a diameter of the first filter member is more than or equal to three times and less than or equal to six times as larger as a diameter of the second filter member.

23. An ink jet recording apparatus according to claim 19, wherein a plurality of filter members different from said first filter member are provided in said ink supply member between said ink discharging port and said first filter member.

24. An ink jet recording apparatus according to any one of claims 19 to 23, further comprising a carriage for conveying said ink jet recording portion in a given direction.

25. An ink jet recording apparatus according to any one of claims 19 to 23, further comprising a conveying mechanism for conveying a recording medium to a recording area where recording is executed by said ink jet recording portion.

26. An ink jet recording apparatus according to any one of claims 19 to 23, wherein said second filter member comprises an aggregate of pipe members.

27. An ink jet recording apparatus according to any one of claims 19 to 23, wherein said second filter member comprises a wall portion having a plurality of holes integrally formed on the end of the ink supply member adjacent said ink reservoir portion.

28. An ink jet recording apparatus according to any of claims 19 to 23, wherein said ink jet recording portion comprises an ink jet recording head provided with electrothermal transducers generating thermal energy utilized for discharging ink.

29. An ink jet recording apparatus according to claim 28, wherein said ink jet recording head discharges ink from the ink discharging port by utilizing film boiling created by the thermal energy generated by said electrothermal transducers.

* * * * *

UNITED STATES PATENT AND TRADEMARK OFFICE

CERTIFICATE OF CORRECTION

PATENT NO. : 5,481,289

DATED : January 2, 1996

INVENTOR(S) : TERUO ARASHIMA ET AL.

It is certified that error appears in the above-identified patent and that said Letters Patent is hereby corrected as shown below:

COLUMN 1

Line 27, "others" should read --other--.

COLUMN 4

Line 47, "is" should read --is for--.

COLUMN 5

Line 67, "form" should read --from--.

COLUMN 6

Line 52, "forgoing" should read --foregoing--.

COLUMN 7

Line 24, "adapted" should read --adopted--.
Line 26, "it is" should read --is it--.

UNITED STATES PATENT AND TRADEMARK OFFICE

CERTIFICATE OF CORRECTION

PATENT NO. : 5,481,289

DATED : January 2, 1996

INVENTOR(S) : TERUO ARASHIMA ET AL.

It is certified that error appears in the above-identified patent and that said Letters Patent is hereby corrected as shown below:

COLUMN 9

Line 65, "a" should read --an--.

COLUMN 11

Line 52, "remain" should read --remaining--.
Line 67, "doubled," should read --doubled;--.

COLUMN 12

Line 2, "secured." should read --secured).--.
Line 50, "32." should read --63.--.

COLUMN 13

Line 67, "nucleation" should read --nucleate--.

COLUMN 14

Line 56, "preliminarily" should read --preliminary--.

COLUMN 15

Line 64, "filer," should read --filter,--.

UNITED STATES PATENT AND TRADEMARK OFFICE

CERTIFICATE OF CORRECTION

PATENT NO. : 5,481,289

DATED : January 2, 1996

INVENTOR(S) : TERUO ARASHIMA ET AL.

It is certified that error appears in the above-identified patent and that said Letters Patent is hereby corrected as shown below:

COLUMN 17

Line 44, "loess" should read --less--.
Line 65, "supply" should be deleted.

COLUMN 18

Line 52, "A" should read --An--.
Line 64, "larger" should read --large--.

Signed and Sealed this

Twenty-fifth Day of June, 1996

Bruce Lehman

*Attest:*

BRUCE LEHMAN

*Attesting Officer*

*Commissioner of Patents and Trademarks*